US006082282A

United States Patent [19]

Kickert

[11] Patent Number: 6,082,282

[45] Date of Patent: Jul. 4, 2000

[54] ROLLING REEF SYSTEM FOR THE MAINSAIL OF A SAILING VESSEL

[76] Inventor: Marcus Claudius Kickert, Olaertduijnweg 8, Rockanje, Netherlands

[21] Appl. No.: 09/331,878

[22] PCT Filed: Jan. 5, 1998

[86] PCT No.: PCT/NL98/00003

§ 371 Date: Jun. 28, 1999

§ 102(e) Date: Jun. 28, 1999

[87] PCT Pub. No.: WO98/30442

PCT Pub. Date: Jul. 16, 1998

[30] Foreign Application Priority Data

Jun. 1, 1997 [NL] Netherlands ..... 1004933

[51] Int. Cl.[7] ..... B63H 9/04

[52] U.S. Cl. ..... 114/106; 114/107

[58] Field of Search ..... 114/106, 107

[56] References Cited

U.S. PATENT DOCUMENTS 3,132,620 5/1964 Court ..... 114/106

4,324,192 4/1982 Ingouf ..... 114/106

5,632,215 5/1997 Moessnang et al. ..... 114/106

FOREIGN PATENT DOCUMENTS 2693975 1/1994 France ..... 114/106

*Primary Examiner*—Stephen Avila

*Attorney, Agent, or Firm*—Brooks & Kushman P.C.

[57] ABSTRACT

A rolling reef system for the main sail (4) of a sailing vessel, the said main sail having an after leech (5), an under leech (7) secured to the boom (3) and a fore leech (6) connected to the mast (2), wherein said boom can be mounted on the mast in such a manner that it is both rotatable along its longitudinal axis and can be swivelled about the mast. The main sail is provided with one or more battens (11, 12) extending practically parallel to the under leech (7) from the after leech up to the fore leech (6). At the end of the boom (3) that is adjacent to the mast, the boom is provided with a disc (9) extending coaxially to the boom and having a significant larger diameter than the boom itself. The fore leech of the main sail comprises a rope (13) having a relatively small guiding profile, said rope is slidably accommodated by and retained in a guiding profile (14) secured to the mast, the said profile extending over practically the entire height of the main sail.

1 Claim, 3 Drawing Sheets

ROLLING REEF SYSTEM FOR THE MAINSAIL OF A SAILING VESSEL

The present invention relates to a rolling reef system for the mainsail of a sailing vessel, as indicated in the preamble to claim 1, and is known from EP-A-0 011 582.

A generally known method for reefing the mainsail involves the use of a so-called rolling reef boom, with which the mainsail is reefed by rotating the boom about its longitudinal axis, thus winding the mainsail about the boom. This method, however, has several drawbacks. On account of the bellied shape of the mainsail, a bulge is formed in the under leech of the mainsail as it is being wound around the boom, which makes it impossible or difficult for the under leech to be drawn taut. Besides the fore leech, since it has to be secured to the mast, comprises more material than the after leech, so that during wrapping a thicker wad of material is created at the front of the boom (near the mast) than at the rear, resulting in the boom sagging (drooping) at the rear. Due to these drawbacks, the rolling reef method has never been widely adopted in practice.

From EP-A-0 011582 a reefing system is known, in which the boom comprises a disc for rotating the boom. Along the mast a guiding element is arranged for guiding the fore leech of the main sail at some distance of the mast. The purpose of this arrangement is to keep the hinge portion of the boom adjacent to the mast free from the main sail when it is wound up on said boom.

The present invention aims to improve the method of rolling reefing to such an extent, that the drawbacks as outlined in the foregoing can be avoided in a simple and highly effective manner.

According to the present invention this aim is achieved by means of an improved rolling reef system.

The battens, co-operating with the disc mounted at the front end of the boom, ensure that the under leech of the mainsail is automatically drawn taut towards the rear when it is wound around the boom. Since the fore leech constitutes of a rope of relatively small diameter, which is guided in a guiding profile separately secured to the mast, the sagging or drooping of the boom is effectively prevented. Thus the proposed measures ensure together that the mainsail can be reefed quickly and easily by wrapping it around the boom, without any of the above mentioned problems occurring.

It has to be noticed that from FR-A-2 693 975 a reefing system is known, in which battens extend from the after leech up to the fore leech. The purpose of these battens is however to prevent the unwinding of the main sail and they are not intended for drawing taut the under leech in co-operation with an abutment such as the disc.

Figure 1:
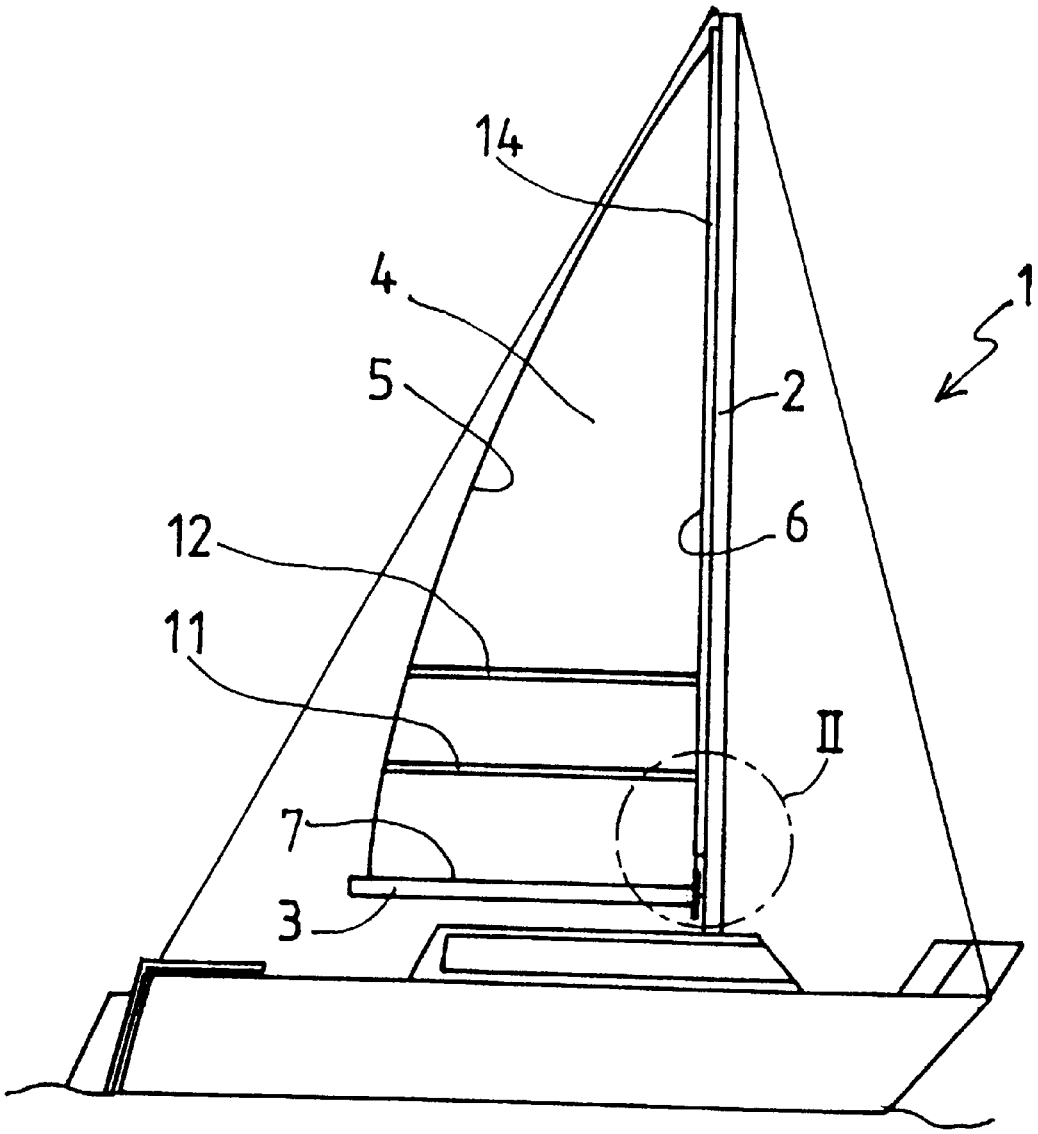
Figure 2:
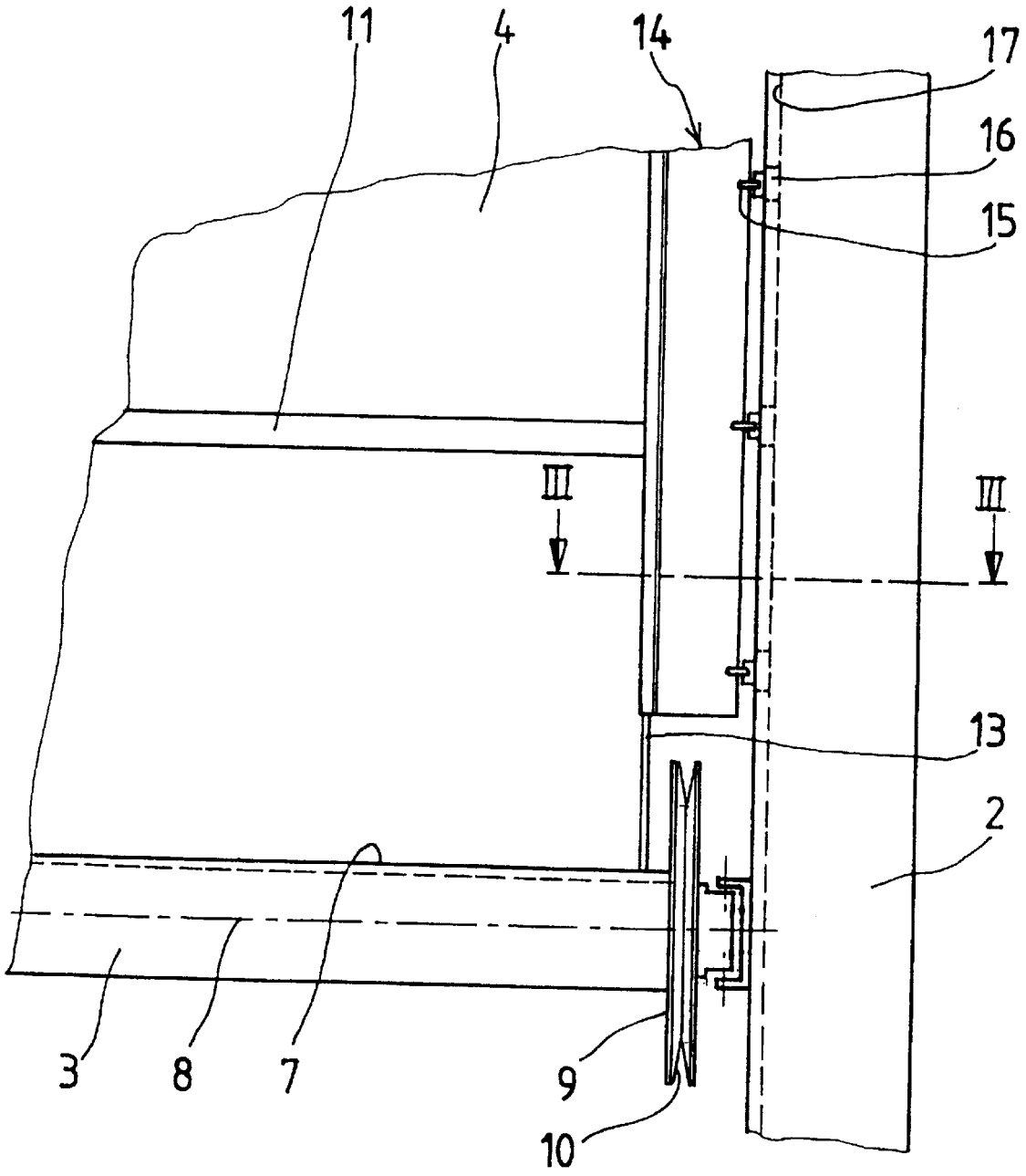

The invention will be elucidated in more detail hereinafter with reference to the accompanying drawings, in which FIG. 1 schematically represents a sailing vessel, equipped with a rolling reef system according to the present invention:

FIG. 2 schematically shows detail II from FIG. 1 on a larger scale; and

Figure 3:
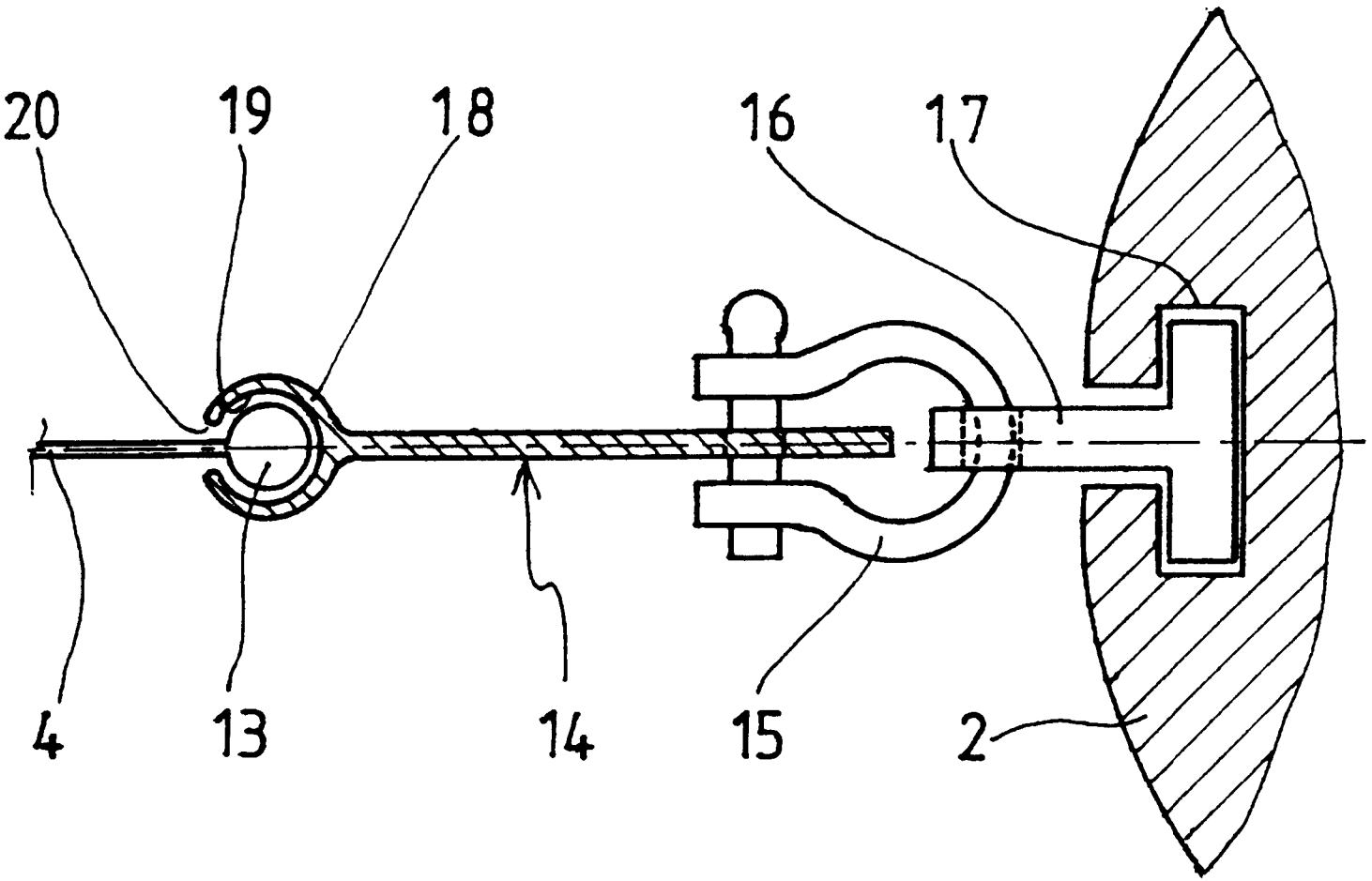

FIG. 3 shows a cross-section along line III—III in FIG. 2 on an even larger scale.

A sailing vessel is schematically represented in FIG. 1, which vessel comprises a mast 2, a boom 3 and a mainsail 4. In the usual manner, the mainsail has an after leech 5, a fore leech 6, which is connected to the mast 2 and an under leech 7 where the mainsail is connected to the boom 3.

Detail II from FIG. 1 is represented on a larger scale in FIG. 2. This figure shows a section of the mast 2 and the section of the boom 3 that is connected to this mast. The boom 3 is connected to the mast in the usual manner, such that it is rotatable about its centre axis 8 and swivellable about the mast 2. At the end of the boom adjacent to the mast a disc 9 is mounted, which extends coaxially to the centre axis 8, said disc having a significantly larger diameter than the boom itself. On its periphery, the disc 9 has a V-shaped groove through which a rope (not drawn) can be guided in order to effect the rotation of the boom 3 about its centre axis 8.

As is clearly visible in FIG. 1, a set of two battens 11, 12 has been provided in the mainsail, said battens extending practically parallel to the under leech 7 over the entire width of the mainsail. These battens therefore extend from the after leech 5 up to the fore leech 6.

One of the main problems occurring with rolling reefing was the fact that due to the convex shape of the mainsail, a bulge is formed in the under leech 7 as the mainsail is being wound around the boom, which makes it impossible for the under leech to be drawn taut. This problem is now solved by the combination of the disc 9 and the batten 11 or 12. The mainsail is now wrapped around the boom until the first batten 11 is disposed under the boom 3. The batten 11 abuts the disc 9 with its front end and extends rearwards from this disc. As the batten extends towards the rear, the under leech 7 is automatically pulled taut. If more reefing is required, the mainsail is wound further around the boom, until the upper batten 12 is disposed under the boom 3 and also abuts the disc 9. The battens 11 and 12, as is customary for battens, consist of a flexible plastic material. It will be clear that a larger or smaller number of these battens may be present in the mainsail. In large sailing vessels you will often find three of these battens, whereas in some cases even four may be desirable.

Another problem related to the sagging or drooping of the boom is solved, according to the invention, both by the particularly construction and guiding of the fore leech 6 of the mainsail. As can be seen in FIGS. 2 and 3, the fore leech of the mainsail comprises a rope 13, having a diameter of approximately 5 mm. This rope is connected to the mast by means of a guiding profile, referred to as a whole by reference numeral 14, and extending practically over the entire height of the mainsail along the mast 2.

As can be seen more clearly in FIG. 3, the guiding profile 14 actually consists of a thin, narrow strip of a suitable plastic material, said strip being provided on the one front elongated side with a number of interspaced shackles 15, each being connected with a carriage or slide 16, which in turn is guided in a guiding groove 17 of the mast 2 in a conventional manner. The other rear elongated side of the guiding profile strip 14 extends parallel to the front side and faces away from the mast 2 at a location to the rear of the disc 9. The guiding profile strip 14 includes a guiding track 18, defining an inner space 19 being substantially circular in cross-section, said space 19 having a narrow longitudinal slit-shaped opening 20. The rear side of the guiding profile strip 14 is located to the rear of the disc 9. The said inner space 19 of the rear side of the guiding profile strip 14 has a diameter, which is a little larger than that of the rope 13, enabling the rope to be slidably accommodated by this space and to be retained therein, whereas the cloth of the mainsail extends outwards through opening 20. The fore leech 6 of the mainsail is thus connected over its entire height to the guiding profile 14, this guiding profile being able to swivel along with the mainsail to a limited extent in relation to the mast 2.

The width of the guiding profile 14 has been chosen such that the extension of the track 18 towards the bottom is aligned with the end of the boom 3 near the disc 9. Together with the chosen width of the band, this configuration enables the mainsail to be wrapped about the boom without any local bulging occurring at the end of the boom disposed near the mast.

The system according to the invention can easily be mounted on existing ships. For this purpose one merely requires a number of adjustments to the mainsail and the boom. Prior to installation, the guiding profile 14 can be hoisted up along the mast 2 and subsequently secured in that position.

It will be clear that the present invention is not limited to the embodiment represented and described here, for within the scope of the accompanying claims, a large number of modifications will be obvious to the man skilled in the art.

What is claimed is:

1. A rolling reef system for the mainsail of a sailing vessel including a mast, a boom secured to said mast for swivelling about the mast and for rotation about the longitudinal axis of the boom, said mainsail having an after leech, an under leech secured to the boom and a fore leech, the system comprising:

a disc secured to the front end of the boom, the disc having a groove used to rotate the boom, and the disc having a diameter significantly larger than the boom;

a guiding profile strip of an elongated shape that extends vertically and has front and rear sides extending parallel to each other, the front side of the guiding profile strip being connected to the mast and the rear side of the guiding profile strip being located to the rear of the disc and having a guiding track for receiving a rope on the fore leech of the mainsail, and the guiding profile strip swiveling with the mainsail about the mast; and a plurality of battens extending parallel to the under leech from the after leech to the fore leech and terminating to the rear of the disc whereby the disc, guiding profile strip and battens cooperating to allow the mainsail to be rolled on the boom without bulging.

* * * * *